United States Patent [19]

Lasley

[11] 4,448,189

[45] May 15, 1984

[54] FLUIDIC VALVE COMBINATION

[76] Inventor: Robert A. Lasley, 508 Sentinel Rd., Moorestown, N.J. 08057

[21] Appl. No.: 366,340

[22] Filed: Apr. 7, 1982

[51] Int. Cl.[3] ..... A61H 9/00

[52] U.S. Cl. ..... 128/25 R; 128/205.26; 128/28; 128/205.24

[58] Field of Search ..... 128/25 R, 28, 30, 30.2, 128/38, 40, 1 B, 205.26, 204.18, 204.19, 204.24, 204.26, 205.14, 205.15, 205.24, 205.26; 604/289, 293; 137/624.14, 569.14, 569.18; 91/318

[56] References Cited

U.S. PATENT DOCUMENTS

| | | | |
|---|---|---|---|
| 3,654,957 | 4/1972 | Fichter | 137/596.14 |
| 3,667,502 | 6/1972 | Otto | 137/624.14 |
| 4,057,059 | 11/1977 | Reid, Jr. et al. | 128/204.24 |
| 4,114,515 | 9/1978 | Pauliukonis | 91/318 |
| 4,236,513 | 12/1980 | Lo Piano | 604/293 |
| 4,301,793 | 11/1981 | Thompson | 128/205.24 |

*Primary Examiner*—Henry J. Recla
*Attorney, Agent, or Firm*—Witherspoon & Hargest

[57] ABSTRACT

A fluidic valve assembly for use with a low pressure hyperbaric chamber, a pressurized source of oxygen, a flow control unit in an oxygen feed line in fluid communication with the chamber, an exhaust valve in fluid communication with the chamber, said exhaust valve being in fluid communication with the oxygen feed line whose pressure maintains the exhaust valve in the closed condition, a one way valve in a first pressure line in fluid communication with the chamber set to allow flow from the chamber at a prescribed pressure, a second pressure line in fluid communication with the chamber, said fluidic valve assembly comprising an inlet flow valve having an inlet connected to the oxygen source and an outlet fluidly connected to the oxygen feed line in communication with the chamber, a closure for closing said outlet, a power assembly connected to the first pressure line for closing said closure when fluid flows in the first pressure line upon the attainment of the prescribed chamber pressure, a first vent for venting the oxygen feed line to atmosphere, the aforesaid power assembly simultaneously opening the first vent to atmosphere with the closing of the closure for the outlet of the inlet flow valve, the decrease of pressure in the oxygen feed line allowing the exhaust valve to open to vent the chamber to atmosphere, a second vent for venting the power assembly, and a pressure assembly connected to the second pressure line in fluid communication with the chamber for controlling the second vent in response to chamber pressure wherein upon the loss of pressure in the chamber, the pressure in the aforesaid pressure assembly decreases to allow the second vent to open to vent the power assembly to atmosphere whereby the oxygen pressure from the timer will force open the closure for the outlet of the inlet flow valve and simultaneously close the first vent to open fluid flow between the outlet and the chamber through the oxygen feed line to commence a new cycle.

6 Claims, 3 Drawing Figures

FLUIDIC VALVE COMBINATION

BACKGROUND AND OBJECTS OF THE INVENTION

This invention relates to hyperbaric chambers and more particularly to fluidic valve means to assist in controlling the functioning of the chamber for its intended purposes.

This invention is an improvement on applicant's earlier U.S. Pat. No. 4,296,743 issued on Oct. 27, 1981 and entitled "Hyperbaric Oxygen Chamber with Fluidic Control". In this improved unit all operation and control is accomplished fluidically thereby assuring that the ultimate in safety is provided. This is particularly important in view of the fact that the operating fluid is generally oxygen.

In view of the foregoing it is an object of this invention to provide improved fluidic controls for operating the hyperbaric chamber.

It is another object of this invention to provide improved fluidic valve means which will function smoothly and reliably throughout the time and pressure cycles desired.

It is yet another object of this invention to provide improved fluidic valve means which are more compact and economical to manufacture and assemble.

The above and additional objects will become more apparent when taken in consideration with the following detailed description and drawings showing by way of example a preferred embodiment of this invention.

IN THE DRAWINGS

FIG. 1 is a generally perspective view of a hyperbaric chamber with the fluidic valve means of this invention shown in cross section and in the no flow condition, FIG. 2 is a cross sectional view of the fluidic valve means of FIG. 1 and wherein said means is in the flow condition, and FIG. 3 is an enlarged view of a portion of FIG. 1 illustrating the feed channel vent valve assembly.

DETAILED DESCRIPTION

Figure 1:
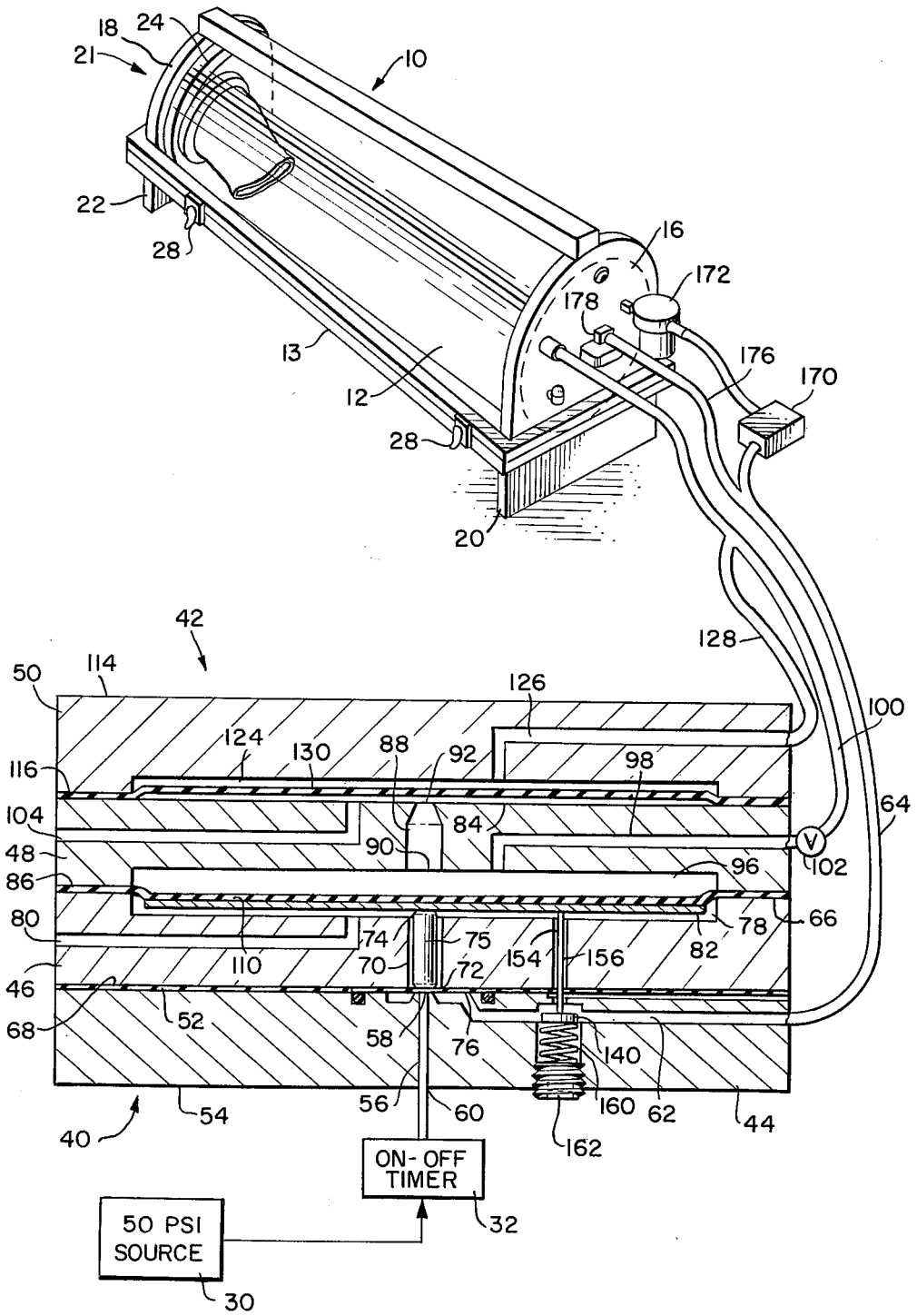

As best shown in FIG. 1, the hyperbaric chamber 10 includes two parts an upper portion 12 and a lower portion 13 suitably held together by latches 38. The chamber is supported by end upright members 20 and 22. One end of the chamber is closed off by a vertical service wall 16 adapted to receive the various pipes, conduits and other apparatus while the other end 18 is provided with an opening 21 adapted to allow the introduction of a patient's limb into said chamber through sleeve 24. Suitable seal means are provided to maintain an air tight condition around the patient's limb. Further details of the hyperbaric chamber may be had by reference to applicant's U.S. Pat. No. 4,296,743 which is incorporated herein for reference.

A source 30 of 30–70 psi oxygen is connected to on-off timer 32 which includes a timer mechanism for turning a valve off upon the completion of the set treatment period.

The on-off timer 32 is connected to the fluidic valve means of this invention. The fluidic valve means 40 comprises a main body 42 having a first body 44, a second body 46, a third body 48 and a fourth body 50.

The first body 44 is circular and has generally parallel top and bottom surfaces 52 and 54 respectively. The first body is provided with a central passage 56 extending vertically therethrough with its outlet 58 in the top surface 52 and its inlet 60 in the bottom surface 54. The inlet 60 is fluidly connected to on-off timer unit 32. A feed channel 62 is in communication with outlet 58 and is connected to feed line 64 which is in communication with the interior of the hyperbaric chamber 10.

The second body 46 is circular and of the same outside diameter as the first body and has generally parallel top and bottom surfaces 66 and 68 respectively. The second body 46 is positioned on top of the first body 44 with its bottom surface 68 confronting top surface 52 of the first body 44. The second body 46 has a central vertical hole 70 extending therethrough and in alignment with central passage 56 in first body 44. The central hole 70 is provided with an inlet 72 in the body's bottom surface 68 and an outlet 74 in the body's top surface 66. A plunger rod 75 is reciprocally carried within the central hole 70.

A flexible diaphragm 76 is held between confronting surfaces of the first and second bodies and extends over and covers the central passage 56 an outlet 58 in the first body. Said flexible diaphragm 76 flexes under pressure to open or close off communication between the central passage 56 and feed channel 62.

The second body 46 has a chamber 78 formed in its top portion said chamber being connected to central vertical hole 70 and its outlet 74. An exhaust conduit 80 is formed in the second body to connect chamber 78 with the outside ambient conditions. An actuator plate 82 is reciprocally carried in the chamber 78 and is in operative contact with the plunger rod 75.

The third body 48 has generally parallel top and bottom surfaces 84 and 86 respectively and is circular in shape with the same diameter as the second body. The third body 48 is positioned on the second body 46 with its bottom surface 86 in face to face position with the top surface 66 of the second body 46. The third body 48 is provided with a central vertical opening 88 with its inlet 90 on the bottom portion and its outlet 92 of reduced diameter in the top surface 84. A pressure chamber 96 is formed in the bottom portion of the third body 48 and is generally coextensive with chamber 78 in the top of the second body 46. A pressure passage 98 formed in the third body 48 connects pressure chamber 96 with a pressure feed line 100 outside the body and in communication with the interior of the hyperbaric chamber 10. A poppet valve 102 is positioned in the pressure feed line 100 to control and allow flow at a preset or higher pressure into passage 98 and pressure chamber 96. The third body 48 is provided with a vent passage 104 placing the outlet 92 in the third body 48 in communication with the outside when the flexible diaphragm 130 is flexed upwardly.

A flexible diaphragm 110 is positioned between the confronting faces of the second and third bodies 46 and 48 respectively to maintain chamber 78 which is always at atmospheric pressure and pressure chamber 96 sealed from one another in air tight manner. An actuator plate 82 is positioned in chamber 78 for vertical reciprocation therein under the action of plunger rod 75 and flexible diaphragm 110.

A fourth body 50 having generally parallel top and bottom surfaces 114 and 116 respectively and being of circular configuration is positioned on top of the third body 48 with the bottom face 116 of the fourth body in face to face position with the top surface 84 of the third body. A chamber 124 is centrally formed in the bottom of the fourth body 50 which body is also provided with a passageway 126 connected to chamber 124 and to line 128 which is in communication with the pressure within the hyperbaric chamber 10 by way of line pressure feed line 100.

The flexible diaphragm 130 which is positioned between the third body 48 and the fourth body 50 closes off chamber 124 from outlet 92 and vent passage 104. Upon pressurization of chamber 124 diaphragm 130 will flex downwardly and close off outlet 92 of the central vertical opening 88 in the third body.

Figure 3:
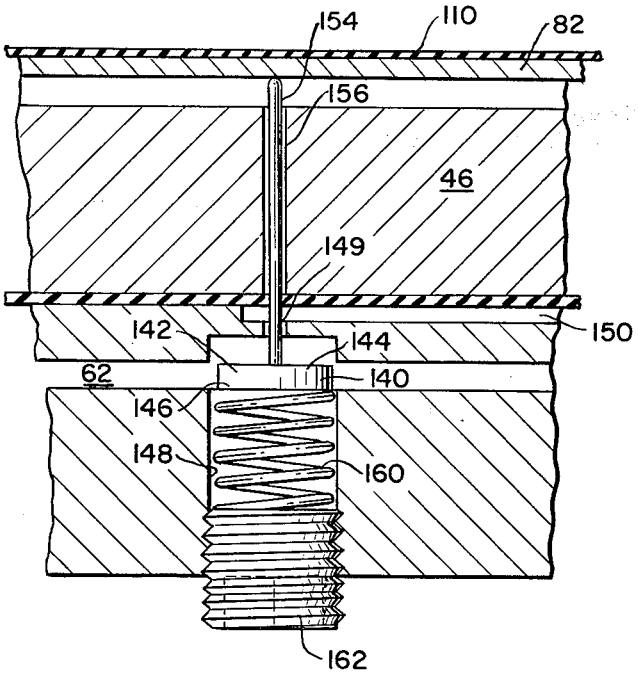

To facilitate the movement of plunger rod 75 against the pressure in feed channel 62 the first body 44 is provided with a pressure relief valve 140 (see FIG. 3). The pressure relief valve 140 comprises a valve body 142 having a top 144 and a bottom 146. The top of the valve body 142 has a valve stem 154 extending upwardly therefrom through opening 149 in first body 44 and valve stem guide hole 156 in the second body 46. It will be noted that the top end of the valve stem 154 is in contact with actuation plate 82 as is the top end of plunger rod 75. Movement of valve body 142 downwardly under action of actuator plate 82 vents the pressure in feed channel 62 to the outside atmosphere by way of opening 149 and connecting bleed channel 150. A valve control spring 160 is positioned in vertical hole 148 between adjusting screw 162 threadedly mounted in hole 148 and the bottom 146 of the valve body 142. Enough force is provided by the spring 160 to make certain that valve body 142 firmly seals off opening 149 when there is no pressure on diaphragm 110, actuator plate 82 and valve stem 154.

As illustrated in FIG. 1, feed channel 62 is connected to feed line 64 which feeds oxygen to the interior of the hyperbaric chamber 10. Interposed in the feed line 64 is feed control means 170 which serves to control the rate of discharge from the feed line 64 into the hyperbaric chamber. A humidifier 172 may be provided in feed line 64 to maintain the contents within the hyperbaric chamber at the desired humidity level. An exhaust control line 176 is connected to the feed line 64 and exhaust valve 178 mounted on end wall 16 of the hyperbaric chamber. The exhaust valve is held in closed position by the feed line pressure and upon cut off of same allows the exhaust valve to vent the hyperbaric chamber to the atmosphere.

The operation of the aforedescribed fluidic valve means as it cooperates in the functioning of a hyperbaric chamber is as follows. A source of pressurized oxygen 30 feeds said oxygen to on-off timer 32 which controls flow in the overall for the desired treatment period involving numerous cycles of pressure and then no pressure in the hyperbaric chamber. Oxygen at a specific pressure between 30–70 psi flows into central passage 56 in the first body 44 thereby causing flexible diaphragm 76 which covers outlet 58 of the central passage 56 to flex upwardly thereby establishing flow communication with feed channel 62. Simultaneously, the upwardly flexing diaphragm 76 moves plunger rod 75 upwardly causing actuator plate 82 to move upwardly and thereby allow the vent control valve 140 to move upwardly under the action of spring 160 so that valve 140 will close off opening 149 and allow flow to proceed through feed line 64 and feed line control means 170 into hyperbaric chamber 10 to pressurize same. Flow through feed line 64 produces pressure at exhaust valve 178 through exhaust control line 176 to maintain the exhaust valve 178 in closed condition.

Chamber 124 in the fourth body 50 is pressurized at hyperbaric chamber pressure by way of passageway 126 and line 128 in communication with said hyperbaric chamber. Pressure in chamber 124 causes diaphragm 130 to move downwardly and close off outlet 92 of the central vertical opening 88 in the third body 48.

Figure 2:
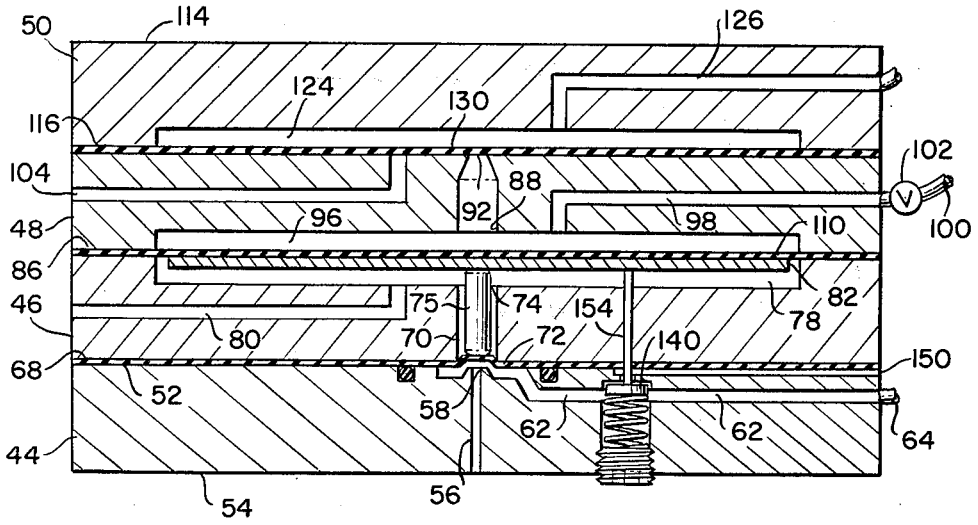

The fluidic valve means 40 in the aforedescribed condition is illustrated in FIG. 2 of the drawings. Chamber 124 is pressurized to close off outlet 92 in the third body 48. Flow is established through central passage 56, feed channel 62 and feed line 64 to the feed control means 170 and then into the hyperbaric chamber. Chamber 78 in the top of the second body 46 is vented to atmosphere through exhaust conduit 80. Pressure chamber 96 remains unpressurized with outlet 92 closed off by diaphragm 130.

Upon the attainment of the prescribed pressure within the hyperbaric chamber, a charge of pressurized oxygen is released by poppet valve 102, which charge proceeds through pressure passage 98 into pressure chamber 96. Since outlet 92 is closed the charge forces diaphragm 110 downwardly which in turn forces actuator plate 82 downwardly thus causing plunger rod 75 to descend and force diaphragm 76 into air tight engagement with outlet 58 thereby closing off the supply of pressurized oxygen to the hyperbaric chamber. Simultaneously, valve stem 154 is forced down by actuator plate 82 to cause valve body 142 to move downwardly and thereby vent feed channel 62 to atmosphere through opening 149 and channel 150. Upon cut off of pressure in feed line 64 the pressure in exhaust control line 176 is lowered so that the exhaust valve 178 will open to vent the hyperbaric chamber to the atmosphere. As soon as the pressure in the hyperbaric chamber drops to atmospheric pressure or other chosen pressure, the pressure line 128 will likewise be reduced thereby allowing the pressure charge in chamber 96 to force the diaphragm 130 upwardly and thereby vent said chamber 96 to the outside by way of vent passage 104. With the reduction of pressure in pressure chamber 96, the pressurized oxygen in central passage 56 pushes diaphragm 76 upwardly to provide communication with feed channel 62. Simultaneously valve body 142 moves upwardly to close off vent channel 150 and another pressure cycle commences.

In actual practice oxygen at a prescribed pressure, for example 50 psi, is fed to the hyperbaric chamber 10 at a slow rate of about 10 liters per minute through feed control means 170. The flow of oxygen is stopped when the pressure within the chamber reaches a preset level of approximately 50 mm Hg. or about 0.9 psi.

It will be apparent to persons skilled in this art that various changes in shape, size and the like, as well as changes in materials may be made without departing from this invention as covered by the following claims.

What is claimed is:

1. A low pressure hyperbaric device adapted for use in conjunction with a pressure source of oxygen for treatment of a patient including a chamber having an entrance adapted to allow the introduction of a body part, means associated with the entrance to seal the body part thereto and thereby provide an air tight chamber, timing means for controlling treatment time connected in series with the pressure source of oxygen, said timing means including an on-off valve for starting and stopping oxygen flow, an oxygen feed line in fluid communication with the chamber, said oxygen feed line having an oxygen flow control means therein, an exhaust valve in fluid communication with the chamber, said exhaust valve being in fluid communication with the oxygen feed line whose pressure maintains the exhaust valve in the closed condition, a first pressure line in fluid communication with the chamber, said first pressure line having a one way valve therein set to allow flow from the chamber at a prescribed pressure, a second pressure line in fluid communication with the chamber, and a fluidic valve means operatively associated with the aforementioned apparatus, said fluidic valve means comprising an inlet flow valve having an inlet and an outlet, the inlet being fluidly connected to the timing means, the outlet being fluidly connected to the oxygen feed line in communication with the chamber, closure means for closing said outlet, power means connected to the first pressure line via said one way valve for closing said closure means when fluid flows in the first pressure line upon attainment of the prescribed chamber pressure, a first vent means for venting the oxygen feed line to atmosphere, the aforesaid power means simultaneously opening the first vent means to atmosphere with the closure of the closure means for the outlet of the inlet flow valve, the decrease in pressure in the oxygen feed line allowing the exhaust valve to open to vent the chamber to atmosphere, a second vent means for venting the power means, and pressure means connected to the second pressure line in fluid communication with the chamber for controlling the second venting means in response to chamber pressure wherein upon the loss of pressure in the chamber, the pressure in the aforesaid pressure means decreases to allow the second venting means to open to vent the power means to atmosphere whereby the oxygen pressure from the timing means will force open the closure means for the inlet and simultaneously close the first vent means to open fluid flow between the outlet and the chamber through the oxygen feed line to commence a new cycle.

2. The invention as set forth in claim 1 and wherein the closure means for closing said outlet is a plunger operated by the power means.

3. The invention as set forth in claim 2 and wherein a diaphragm is positioned between the plunger and the valve outlet whereby the diaphragm will close off the outlet valve when the plunger is operated by the power means.

4. The invention as set forth in claim 2 and wherein the power means comprises diaphragm chamber means fluidly connected to the first pressurized line, said diaphragm chamber means including a diaphragm responsive to the pressure in the first pressurized line and operatively associated with the plunger and the first vent means to respectively depress the diaphragm between the plunger and outlet valve to close the outlet of the inlet flow valve and open the first vent means to atmosphere.

5. The invention as set forth in claim 4 and wherein the pressure means connected to the second pressure line comprises a diaphragm chamber assembly including a diaphragm responsive to the pressure in the second pressure line on one side and on the other side to the pressure in the diaphragm chamber in communication with the first pressure line and operatively associated with the second venting means whereby upon the loss of pressure in the chamber and the second pressure line the pressure from the diaphragm chamber in communication with the first pressure line will move the diaphragm to open the second venting means to vent the pressure from the diaphragm chamber in communication with the first pressure line to atmosphere.

6. A low pressure hyperbaric device for treatment of a patient including a chamber having an entrance adapted to allow the introduction of a body part, means associated with the entrance to seal the body part thereto and thereby provide an air tight chamber, a pressure source of oxygen, timing means for controlling treatment time connected in series with the pressure source of oxygen, said timing means including an on-off valve for starting and stopping oxygen flow, an oxygen feed line having an oxygen flow control means therein, an exhaust valve in fluid communication with the chamber, said exhaust valve being in fluid communication with the oxygen feed line whose pressure maintains the exhaust valve in the closed condition, a first pressure line in fluid communication with the chamber, said first pressure line having a one way pressure controlled valve therein set to allow flow from the chamber at a prescribed pressure, a second pressure line in fluid communication with the chamber, and fluidic valve means operatively associated with the aforementioned apparatus, said fluidic valve means comprising a main body, said main body comprising a first body, a second body, a third body and a fourth body all secured together consecutively to form said main body, the first body having generally parallel top and bottom surfaces, a central passage extending vertically through the first body with its inlet side in the bottom surface and its outlet side in the top surface, an oxygen feed channel having one end opening in the upper surface of the first body and adapted to be in communication with the outlet of said central passage and its opposite end connected to the oxygen feed line being in communication with the inside of the hyperbaric chamber, a second body having generally parallel top and bottom surfaces, said second body being attached to the first body with its bottom surface in face to face position with the top of the first body, said second body having a central vertical hole aligned with the central passage in the first body, said central hole having an inlet in its bottom surface and an outlet in its upper surface, a plunger rod reciprocally carried within the central vertical hole in said body, a first flexible diaphragm held between the first and second bodies covering the outlet of the central passage and the one end of the oxygen feed channel in the first body, said first diaphragm being adapted to close off communication between the central passage and the feed channel of the first body, the second body having a chamber formed in its top portion and connected to the outlet of the central hole in said second body, an exhaust conduit extending from the chamber to the outside of the second body, an actuator plate reciprocally carried in said chamber and in operative contact with the plunger carried in the central vertical hole, a third body having generally parallel top and bottom surfaces, said third body being attached to the second body with its bottom surface in face to face position with the top surface of the second body, said third body having an exhaust conduit having one end opening in the top surface thereof and extending to the outside of the third body, the third body having a central vertical opening with its inlet in its bottom surface and its outlet in its top surfaces, said outlet being reduced in size as compared to the central vertical opening, a pressure chamber formed in the bottom portion of said third body, said pressure chamber being generally coextensive with the chamber in the upper portion of the second body, a pressure passage in said third body connected to the pressure chamber and to said first pressure line having said one way valve therein, said first pressure line being in communication with the pressure in the hyperbaric chamber, said one way valve comprising a pressure responsive poppet valve responsive to a prescribed pressure in the first pressure line whereby pressure from said first pressure line is communicated to said pressure chamber, a second flexible diaphragm positioned between the confronting surfaces of the second and third bodies to form an air tight seal between the pressure chamber in the third body and the chamber in the upper portion of the second body said second diaphragm being fixed to said actuator plate in said chamber formed in the top portion of the second body, the first body having a vent control valve therein and a bleed channel in communication with the outside of the first body, said control valve comprising a vertical valve passage communicating between said oxygen feed channel and said bleed channel, and a valve body having a top and a bottom and being moveable within vertical valve passage in the first body, said second body having a valve stem guide hole aligned with said vertical valve passage and extending between said chamber in the upper portion of the second body and said vertical valve passage, the top of the valve body having a stem extending upwardly therefrom and through said valve stem guide hole in the second body and into contact with the actuator plate, adjustable spring means in contact with the bottom of the valve body to vary pressure thereon, whereby when the timer is set and with the oxygen source at approximately 50 psi oxygen is fed to the central passage in the first body so that the flexible diaphragm covering the central passage outlet is raised upwardly thereby allowing the plunger rod to raise upwardly and close the vent control valve wherein flow is established to the interior of the hyperbaric chamber through the oxygen feed channel, a fourth body having generally parallel top and bottom surfaces, said fourth body being attached to the third body with its bottom surface in face to face position with the top surface of the third body, a chamber in the bottom portion of the fourth body, a passageway in communication with said chamber and said second pressurized line in communication with the inside of the hyperbaric chamber, flexible diaphragm positioned between the confronting surfaces of the third and fourth bodies to close off the chamber thereabove, and cover said outlet of said central vertical opening and said one end of said exhaust conduit in said third body, said diaphragm being responsive to the pressure inside the hyperbaric chamber, whereby the chamber in the fourth body in communication with the hyperbaric chamber is pressurized to cause the flexible diaphragm therein to flex downwardly and close off the outlet of the central vertical opening in the third body, upon attainment of the prescribed pressure within the hyperbaric chamber the one way pressure controlled valve will open and introduce a charge into the pressure passage and thus the pressure chamber thereby causing the diaphragm between the second and third bodies to flex downwardly causing the actuator plate to move downwardly driving the plunger rod downwardly to force the diaphragm between the first and second bodies in contact with the plunger rod to move downwardly and close off the outlet of the central passage in the first body thereby cutting off the flow of pressurized oxygen, simultaneously the actuator plate forces the valve stem of the vent control valve downwardly to vent the oxygen feed channel to the outside, with the reduction of pressure in the oxygen feed line the exhaust valve opens to vent the hyperbaric chamber, upon reduction of pressure in the chamber of the fourth body due to venting of the hyperbaric chamber the outlet of the central vertical opening will be opened by pressure in the pressure chamber whereby said pressure in the said pressure chamber will be vented thereby allowing the pressure in the central passage to again raise the diaphragm and plunger rod to repeat the cycle.

* * * * *